US005472181A

United States Patent [19]

Lowell

[11] Patent Number: 5,472,181

[45] Date of Patent: Dec. 5, 1995

[54] SYSTEM AND APPARATUS FOR ACCUMULATING AND STITCHING SHEETS

[75] Inventor: Kenneth W. Lowell, Bristol, Conn.

[73] Assignee: Pitney Bowes Inc., Stamford, Conn.

[21] Appl. No.: 229,933

[22] Filed: Apr. 18, 1994

[51] Int. Cl.[6] ..... B42B 5/00

[52] U.S. Cl. ..... 270/53

[58] Field of Search ..... 270/53, 37; 355/324

[56] References Cited

U.S. PATENT DOCUMENTS

| | | | |
|---|---|---|---|
| 3,294,394 | 12/1966 | Holms et al. . | |
| 3,502,255 | 3/1970 | Hermann et al. . | |
| 3,554,531 | 1/1971 | Heigl et al. | 279/53 |
| 3,747,823 | 7/1973 | Barland . | |
| 3,747,826 | 7/1973 | Little . | |
| 4,073,391 | 2/1978 | O'Brien et al. | 270/58 X |
| 4,611,741 | 9/1986 | Wilson . | |
| 4,925,172 | 5/1990 | Christy et al. | 270/53 |
| 4,957,284 | 9/1990 | Brabant | 270/37 |
| 4,989,852 | 2/1991 | Gunther . | |
| 5,005,751 | 4/1991 | Radtke et al. . | |
| 5,029,831 | 7/1991 | Green | 270/53 |
| 5,092,509 | 3/1992 | Naito et al. . | |
| 5,207,412 | 5/1993 | Coons et al. . | |
| 5,230,457 | 7/1993 | Hiroi et al. . | |
| 5,382,011 | 1/1995 | Tani | 270/53 X |

*Primary Examiner*—John E. Ryznic

*Attorney, Agent, or Firm*—Charles R. Malandra, Jr.; Melvin J. Scolnick

[57] ABSTRACT

A system and apparatus for accumulating and stitching collations at high speed comprise an accumulation device situated at an upstream end of a deck in which sheets are stacked to form a collation. The accumulation device includes a stacking area, a transport for conveying the sheets into the stacking area, and first gating structure for stopping the sheets in the stacking area to form the collation. A containment device that is adjacent to a downstream end of the accumulation device includes second gating structure for stopping the collation for other than lead edge stitching. A stitcher is adjacent the first gating structure for stitching the collation when a lead edge of the collation is at either the first gating structure or the second gating structure. A pusher transport moves the collation from the accumulation device to the containment device and transports the collation from the containment device. A controller controls the pusher transport wherein the pushers square the collation at substantially the moment an end of collation sheet is conveyed against the first gating structure. The controller is coupled to an encoder for tracking and controlling the position of said pushers. The system also includes the capability for correcting the position of said pushers after a power loss.

17 Claims, 12 Drawing Sheets

SYSTEM AND APPARATUS FOR ACCUMULATING AND STITCHING SHEETS

FIELD OF THE INVENTION

The invention disclosed herein relates to stitching (stapling) apparatus used in document feeding systems, and more particularly to system and apparatus for accumulating and stitching a collation of sheets at high speed.

1. Related Applications

The present application is related to U.S. Applications Ser. Nos. 08/229,934, 08/230,024, 08/228,990, 08/229,932 08/228,990, all concurrently filed herewith, and assigned to the assignee of the present invention.

2. Background of the Invention

There are many applications known in which documents are fed along a paper path and then collated for further processing. Generally, the documents must be properly aligned when the collation is formed before further processing, such as stitching (stapling) or insertion into an envelope, can be performed. Heretofore, stitching apparatus have been structured to stitch in a fixed location relative to the collation being stitched. Typically, stitching is done either at the lead edge or at the trail edge of a collation which has been conveyed to and stopped adjacent to the stitching mechanism.

In some applications, the collation is formed and then stitched at a stacking area. However, such applications, for example in copying machines, are typically performed at a sufficiently slow speed to insure that the collation is properly squared before stitching is performed.

U.S. Pat. No. 3,502,255 issued to Herman et al. on Mar. 24, 1970, discloses a high speed stapling arrangement which operates on collated material fed by an endless conveyor and jogged against stop means at a stapling station. The sheets are handled in reversibly shingled form to allow rapid transport and efficient jogging action against the stop means.

U.S. Pat. No. 4,073,391 issued to O'Brien et al. On Feb. 14, 1978, discloses sheet jogging apparatus for registering the edges of a stack of sheets into an aligned justified bundle which can be subsequently stapled if so elected. All jogging, stapling and eject operations are controlled by a single curved detented cam surface which is rotatably mounted below an inclined jogging deck.

U.S. Pat. No. 5,092,509 issued to Naito et al. on Mar. 3, 1992, discloses a sheet stapling apparatus in a copying machine including a sheet bin for accommodating sheets, a reference member for one side edge of the sheets in the bin, aligning means for urging the sheets in the bin to the reference member, stapling means for stapling the sheets in the bins, and control means for controlling the aligning means so that the aligning means urges the sheets to the reference member and is maintained at the urging position during the sheet stapling operation for the sheets in the bin.

U.S. Pat. No. 5,005,751, issued to Radtke et al. On Apr. 9, 1991, discloses a sheet stacking and stapling apparatus that provides an unobstructed stacking area wherein the feeding direction of the sheets fed to the stacking area need not be changed. The stacking operation is performed on an inclined plane defining a stacking area. The stapling devices laterally substantially surround the stacking area from above and below adjacent to an edged defined by abutments which extend into the feed path of the sheets to stack the sheets.

It is an object of the present invention to provide a system and apparatus for accumulating and stitching large collations at high speed.

It is another object of the present invention to provide a multi-functional programmable stitcher that eliminates the typical customizing of conventional stitchers to meet the various applications that have heretofore required customization as well as new stitching applications.

SUMMARY OF THE INVENTION

The present invention provides a stitching system and apparatus that accumulates sheets into collations of up to fifty sheets. The system and apparatus can be programmed to do positional stitching along the entire length of a document. For example, the present invention is suitable for lead-edge, trail-edge or saddle stitching.

Individual sheets are fed seriatim from an upstream feeding unit to an accumulator section of the stitching apparatus where the sheets are registered against a first set of gates until the entire collation has been accumulated. As the end of collation (EOC) sheet enters the accumulator section, a pair of pushers follow the EOC sheet in and squares the entire collation. Depending on the initial setup parameters, the collation either is stitched and processed out of the accumulator section, or is indexed forward from the accumulator section by the pushers to a predetermined position against a second pair of gates whereby the collation is squared, stitched and processed out of the stitching apparatus.

In accordance with the present invention, a system and apparatus for accumulating and stitching collations at high speed comprise an accumulation device situated at an upstream end of a deck in which sheets are stacked to form a collation. The accumulation device includes a stacking area, a transport for conveying the sheets into the stacking area, and first gating structure for stopping the sheets in the stacking area to form the collation. A containment device that is adjacent to a downstream end of the accumulation device includes second gating structure for stopping the collation for other than lead edge stitching. A stitcher is adjacent the first gating structure for stitching the collation when a lead edge of the collation is at either the first gating structure or the second gating structure. A pusher transport moves the collation from the accumulation device to the containment device and transports the collation from the containment device. A controller controls the pusher transport wherein the pushers square the collation at substantially the moment an end of collation sheet is conveyed against the first gating structure. The controller is coupled to an encoder for tracking and controlling the position of said pushers. The system also includes the capability for correcting the position of said pushers after a power loss.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PRESENT INVENTION

Figures 1, 2:
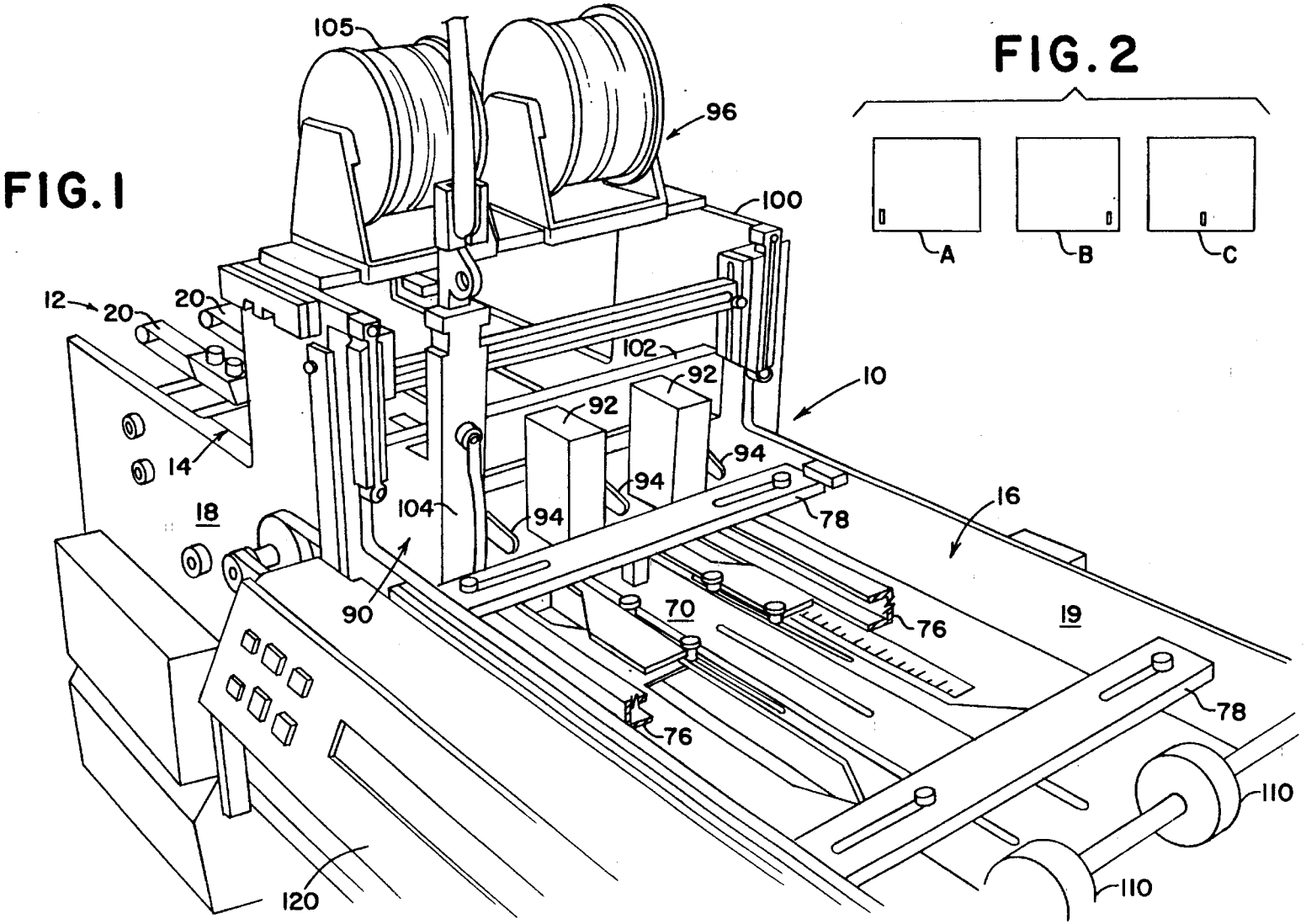
FIG. 1 is a perspective view of the downstream end of the stitching/accumulating apparatus in accordance with the present invention.
FIG. 2 is a representation of lead edge, trail edge and saddle stitching.

In describing the present invention, reference is made to the drawings, wherein there is seen a stitcher/accumulator module, generally designated 10, including an input section 12, an accumulation section 14 and a containment section 16. Stitcher/accumulator module 10 also includes side frame members 18 and 19.

Figure 3:
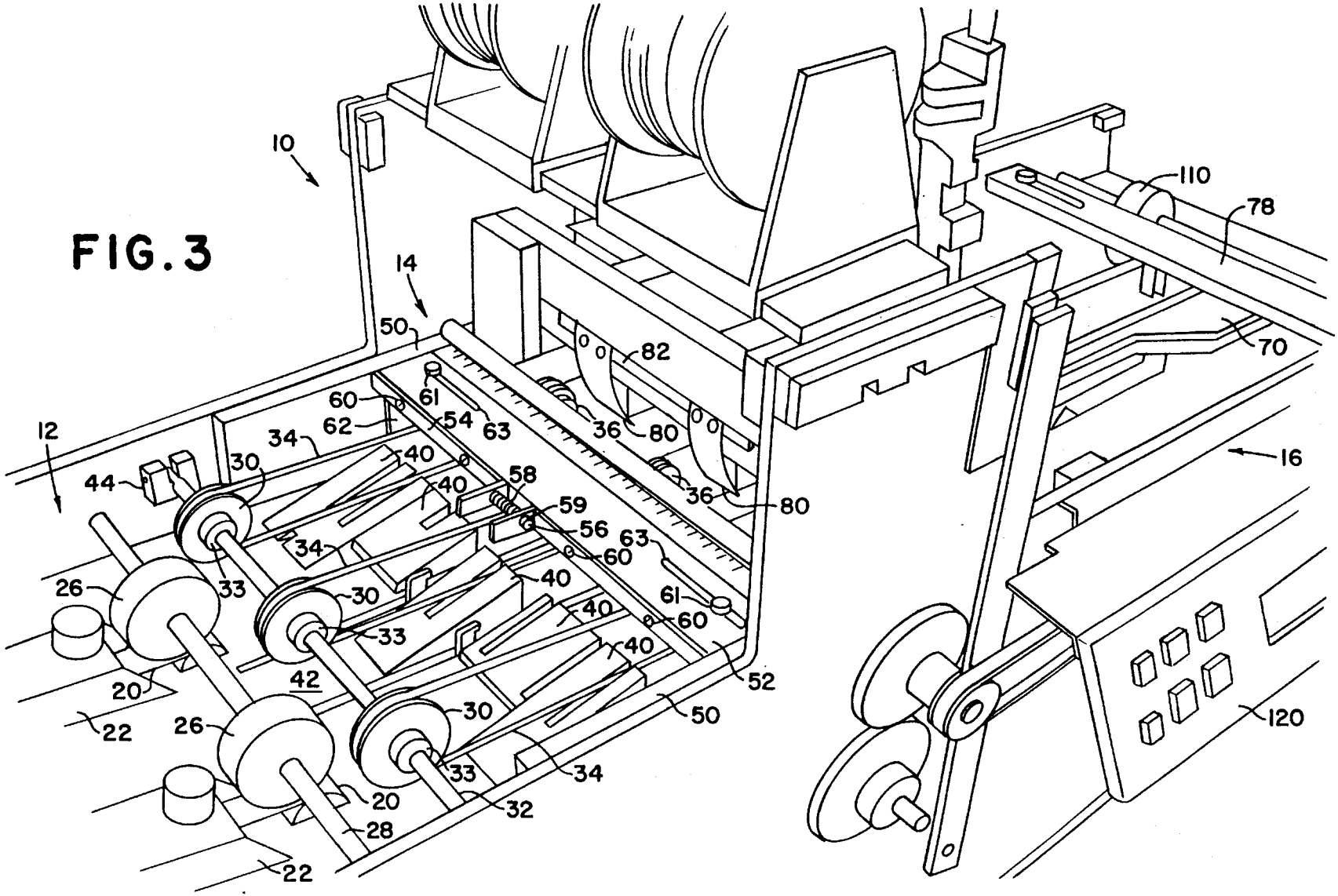
FIG. 3 is an upstream perspective view of the stitching/accumulating apparatus of FIG. 1.

Referring now to FIGS. 1 and 3, input section 12 includes two endless, flat input belts 20 that are driven by a conventional flat belt drive 21. Above each belt 20 is a roller ball carriage 22 which is suspended above belt 20 by a bracket (not shown). Each roller ball carriage 22 includes at least two roller balls 24 that are suspended through respective holes in the bottom of carriage 22 such that roller balls 24 provide a normal force to belts 24 and freely rotate with the movement of belts 24. Preferably, roller balls 24 are ball bearings that protrude through low abrasive plastic cups (not shown) seated in the holes in carriage 22. A pair of conventional idler input rollers 26 that are located above the downstream end of input belts 20 cooperate with belts 20 to provide a positive drive of the sheets 5 as they enter accumulation section 14. Idler input rollers 26 are rotatably mounted on a shaft 28 that is rigidly mounted to side frame members 18 and 19.

Accumulation section 14 includes an upper O-ring belt drive that receives the sheet 5 from input section 12 and conveys the sheet to primary registration gates 66. The O-ring belt drive includes three endless O-ring belts 34 that move around three upstream, idler pulleys 30 and three downstream, drive pulleys 36. Idler pulleys 30 are rotatably mounted on idler pulley shaft 32 and are locked in place on shaft 32 by conventional means, such as spring closure clamps 33. This arrangement provides a non-tool adjustment of idler pulleys 30 along shaft 32 to accommodate different sizes of the sheets being accumulated. Each end of shaft 32 is rectangularly shaped and fits tightly into a U-shaped opening of a locking block 44. A pair of spring plungers 46 in each locking block 44 locks shaft 32 in place. Drive pulleys 36 are secured to shaft 38 via a conventional roller clutch arrangement (not shown). Shaft 38 is journaled in frame members 18 and 19.

There are a plurality of guide ramps 40 that are adjustably mounted on deck plate 42. Guide ramps 40 are adjustable longitudinally for handling a variety of document sizes and have longitudinal slots through which the lower reach of belts 34 move when sheets are moving over the ramps.

Figure 6:
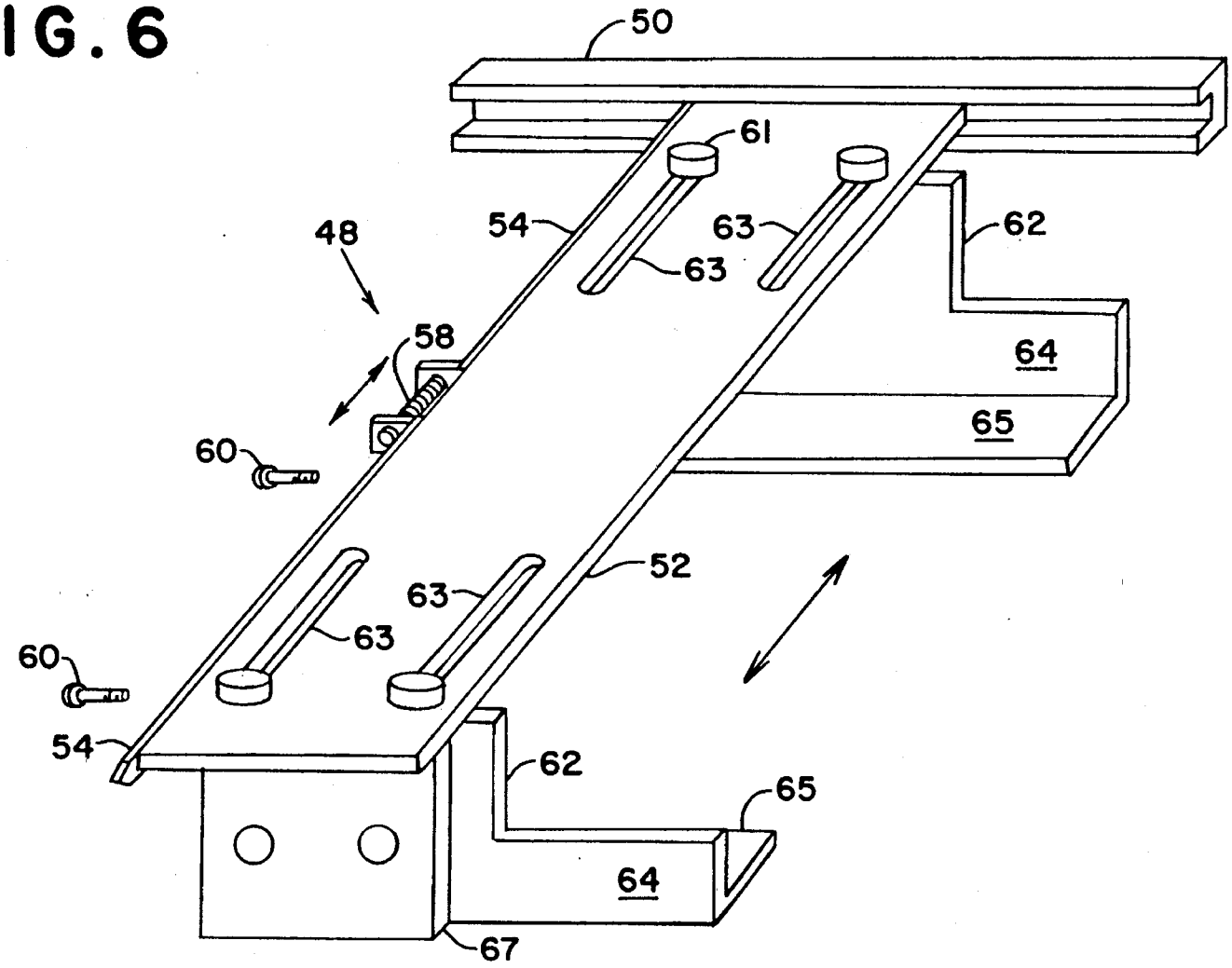
FIG. 6 is a perspective view of a two way adjustable side guide device used in the stitching/accumulating apparatus of FIG. 1.

Referring now to FIGS. 2 and 6, a two-way adjustable side guide assembly 48 is positioned downstream of ramps 40. Side guide assembly 48 includes a pair of laterally spaced side guides 62 that are suspended by a transverse mounting plate 52. In the preferred embodiment of the present invention, side guides 62 are approximately 6 inches long and include a vertical member 64 and a horizontal member 65. Vertical side guide members 64 insure side registration and horizontal member 65 functions as an deck member such that side guide assembly 48 captures sheets as they are transported over ramps 40. Side guides 62 are adjustably suspended from mounting plate 52 via shoulder screws 61 via shoulder screws 61 extending through slots 63 in mounting plate 52 and into mounting block 67 which is fastened to vertical member 64. Mounting plate 52 is slidably mounted in a pair of longitudinal, U-shaped rail guides that are affixed to side frame members 18 and 19. Side guides 62 are longitudinally positionable so as to be suitable for the registration of any size sheets that are conveyed into the accumulator section 14 to form a collation for further processing. Mounting plate 52 includes a locking mechanism that locks mounting plate 52 and thus side guide assembly 48 in a fixed longitudinal position. The locking mechanism includes two locking plates 54 that are held in place by shoulder screws 60, a center shaft 56 and a spring 58. Shoulder screws 60 pass through slots 59 in locking plates 54, whereby locking plates 54 are laterally movable. When locking plates 54 are squeezed together, shoulder screws 60 and side guide assembly 48 freely moves longitudinally within rail guides 50. When plates 54 are released, plates 54 protrude outward causing shoulder screws 60 to lock side guide assembly 48 against rail guides 50. This arrangement provides a self locking, easily positioned registration device that registers less than the entire document length.

Figure 4:
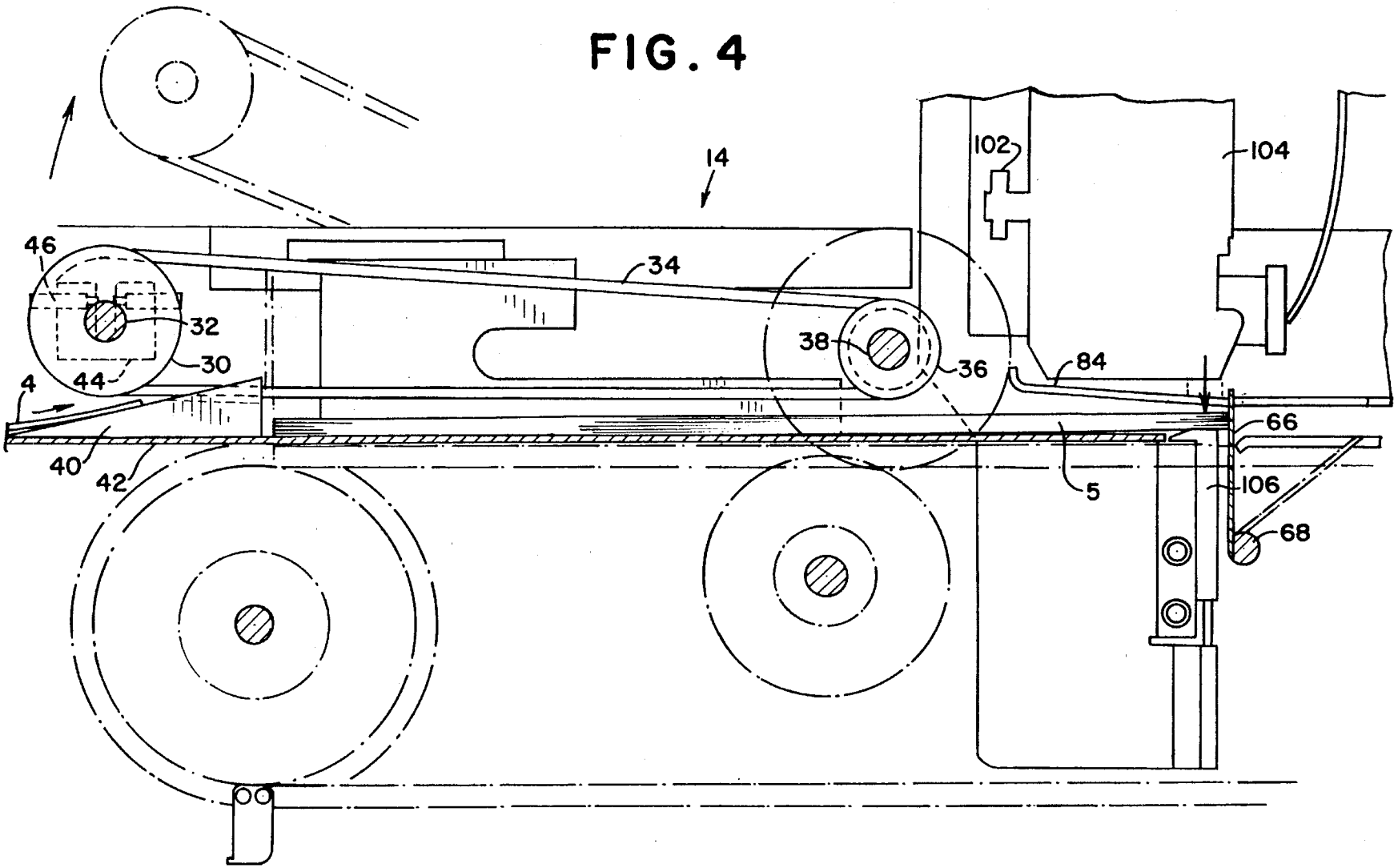
FIG. 4 is a side sectional view of an accumulator section of the stitching/accumulating apparatus of FIG. 1.
Figure 7:
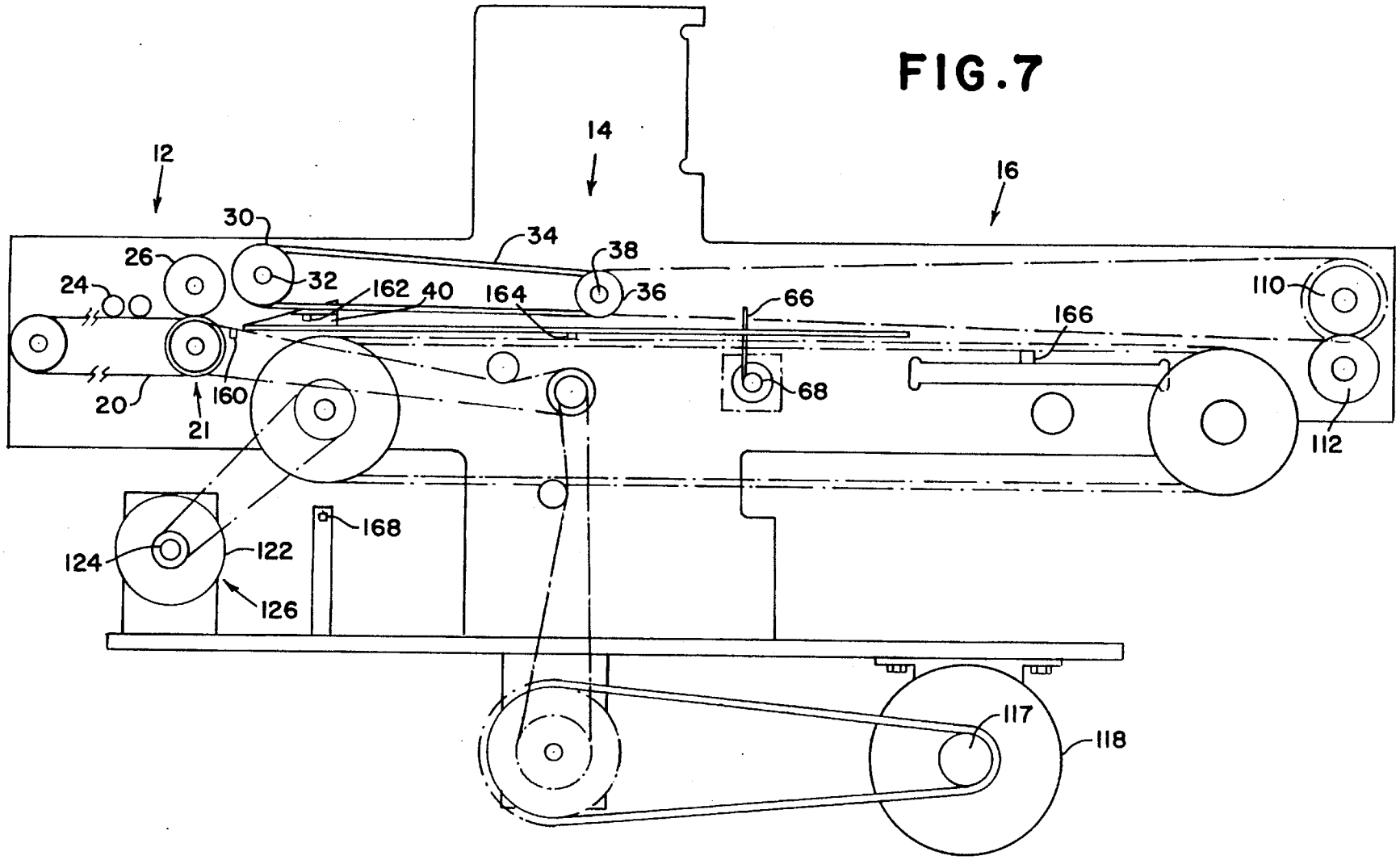
FIG. 7 is a schematic representation of the drive system of the stitching/accumulating apparatus of FIG. 1.

Referring now to FIGS. 4 and 7, at the downstream end of accumulation section 14, a pair of primary registration gates 66 are laterally disposed and pivot about primary gate shaft 68, which is controlled by a solenoid (not shown). In a vertical position gates 66 function as registration stops for accumulation section 14. Gates 66 pivot down when the accumulation has been completed and the collation is being removed from accumulation section 14. There are three spring steel plates 80 (FIG. 1) that are mounted at one end to mounting bar 102 and the other end of which is suspended perpendicular to the paper path in accumulation section 14. Spring plates 80 function as a guide for the leading edge of incoming sheets. This spring action prevents the lead edge of the incoming sheet of large collations from passing over gates 66, prevents "kick back" of the sheet when it hits gates 66 and thus facilitates the squaring of collation 5 against gates 66.

Figure 5:
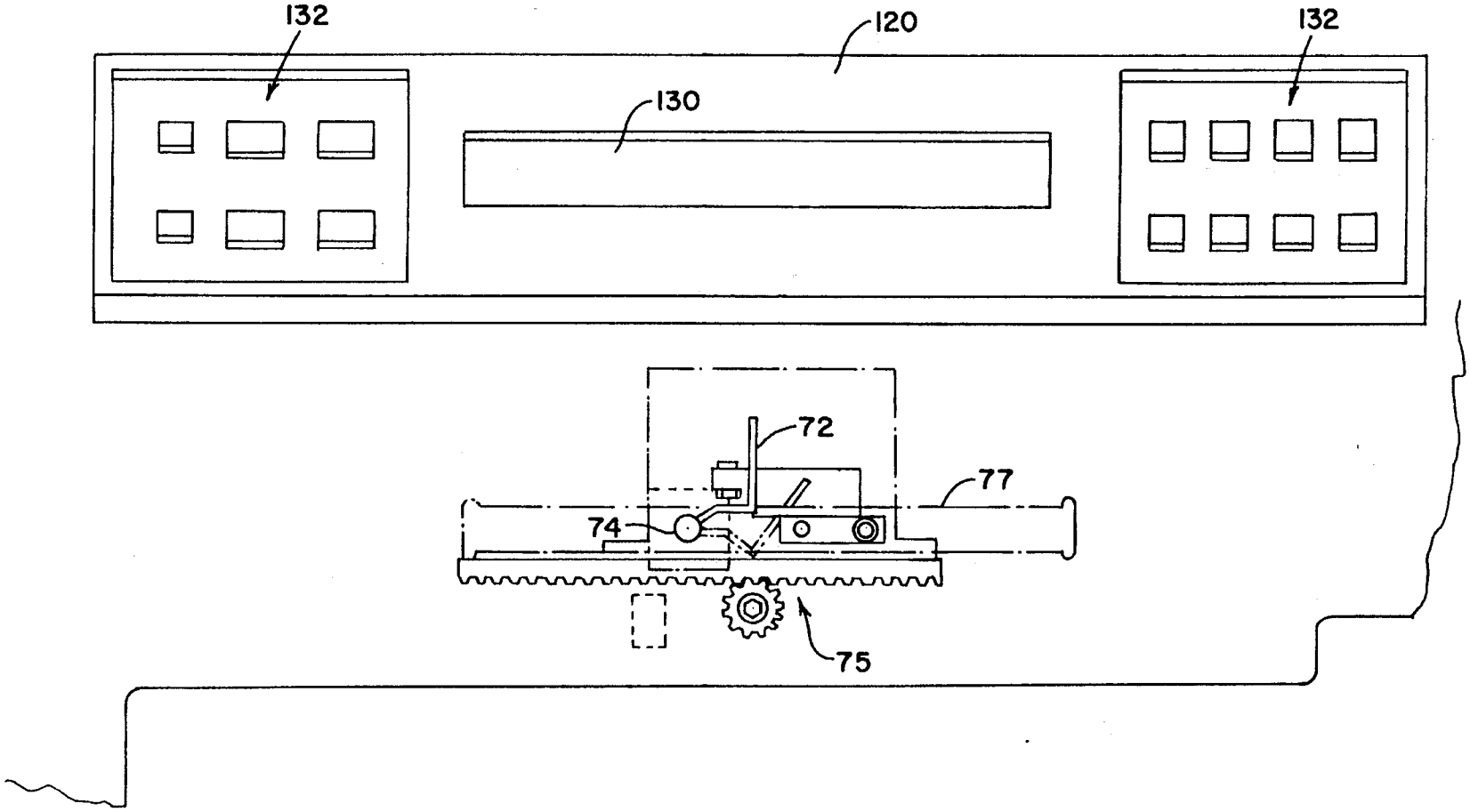
FIG. 5 is side sectional view of a containment section of the stitching/accumulating apparatus of FIG.

Containment section 16 provides containment and registration of collation 5 as it is processed through it at a high speed. Containment section 16 includes a primary containment plate 70 and two registration gates 72 which protrude through primary containment plate 70 when in a stop/registration position. There are two laterally spaced longitudinal registration guides 76 which are adjustably positioned to provide side to side registration of collation conveyed 5 in containment section 16. Registration guides 76 are generally U-shaped and are mounted with the open side of the guides facing each other such that each lateral side of collation 5 is surrounded by one of registration guides 76. There are two extendible arms 84 that are mounted on primary containment plate 70 and extend over the downstream end of accumulation section 14. Arms 84 have a primary function of downwardly guiding the lead edge of sheets being accumulated to ensure that the lead edge hits primary registration gates 66. This is done in conjunction with spring plates 80. Such downward guidance is needed because O-ring belts 34 are positioned above deck 42 at a height sufficient to accumulate up to 50 sheets. Arms 42 further function to guide the lead edge of the collation into containment section 16, thus preventing the lead edge of collation 5 from separating as the collation is conveyed at high speed. The entire containment section 16 is suspended by two cross braces 78 which are fixed to side frame members 18 and 19 of stitcher/accumulator module 10. Primary containment plate 70 is suspended a fixed distance d above deck 42 such that collations of at least 50 sheets pass therebetween. The height of the opening of each side guide 76 is approximately the same fixed distance d. The vertical wall members 79 of side guides 76 are laterally disposed a distance approximately equal to the width of collation 5. Primary containment plate 70 has slots therein through which secondary registration gates 72 pivot. Secondary registration gates 72 pivot about shaft 74. Gates 72 operate as stops when trail edge stitching is desired. A rack and pinion longitudinal gate position adjustment mechanism 75 (FIG. 5) provides means for longitudinally positioning gates 72 for precision trail edge stitching of collations of all size document. Shaft 74 is suspended through slots 77 in side frames 18 and 19 between a pair blocks 73. There is a step in each block that slidably fits within a slot 77 for guiding the positioning of gates 72 by the rack and pinion mechanism 75. A conventional cross brace structure (not shown) supports blocks 73. Shaft 74 extends through one of blocks 73 for coupling to the rotary solenoid mechanism which controls the pivoting of shaft 74 and thus gates 72.

Containment arms 84 are mounted to the underside of primary containment plate 70. Arms 84 are normally extended into the downstream end of accumulation section 14 for guiding the lead edge of the sheet entering accumulation section 14. Arms 84 can be retracted when adjustments are made to stitching mechanism 90. Arms 84 are locked in normal extended configuration by conventional means such as locking screws (not shown)

Referring now to FIGS. 1 and 4, stitching mechanism 90 includes at least one stitch head 104 that is adjustably positioned on a stitch head mounting bar 102. Mounting bar 102 is fixedly mounted on vertical extensions 100 of side frame members 18 and 19. Stitch head 104 feeds a section of wire 105 through collation 5 to be stitched (stapled) toward a clincher 106 which bends the ends of wire 105 to form a staple in a conventional process which is well known. Up to three stitch heads 104 can be mounted on stitch head mounting bar 102 at one time. As seen in FIG. 1, a pair of dummy blocks 92 are mounted to stitch head mounting bar 102 when only one stitch head 104 is used. Stitch head 104 and dummy block 92 are locked in place on stitch head mounting bar 102 by locking arm 94. Wire spools 98 are mounted on an adjustable cradle assembly 96 which accommodates up to three spools.

A collation drive system 108, which moves collation 5 from accumulation section 14, includes two pairs of pushers 116 that are mounted on two, parallel conventional, endless chain drives 114. On each chain drive 114, pushers 114 are 180° apart. Chain drives 114 are conventionally coupled to a pusher servo motor 122.

The present invention performs high speed accumulation and processing of collation 5. Referring now to FIG. 7, drive system 108 is conventionally coupled to an AC. motor 118. Input belts 20 and O-ring belts 34 are driven at approximately 115 inches/second. Pusher 116 are driven at approximately 75 inches/second.

In operation, the present invention provides new system and apparatus for processing, accumulating and stitching collations of sheets fed from different feeding devices, such as web or cut sheets feeders. The system is programmed to perform an operator selectable mode of stitching, such as lead-edge stitching, trail-edge stitching or no stitching. A feeding device (not shown) is coupled to stitcher/accumulator module 10 in a conventional manner. Individual sheets 4 are fed seriatim from the feeding device to input section 12 of stitcher/accumulator module 10. The sheets 4 are then conveyed seriatim by input belts 20 into accumulation section 14 where O-ring belts 34 register the sheets against primary registration gates 66 until an entire collation 5 has been accumulated. As an end of collation (EOC) sheet enters accumulator section 14, pushers 116 follow the EOC sheet in to perform certain programmed functions depending on the mode of stitching selected. If lead-edge stitching mode has been selected, pushers 116 complete the squaring of the entire collation against primary registration gates 66 until the stitching is completed at which time pushers 116 transport collation 5 out of accumulation section 14. Pushers 116 push collation 5 as primary registration gates 66 rotate down to allow collation 5 to be processed out of accumulation section 14. If trail-edge stitching has been selected, collation 5 is indexed forward from accumulator section 14 by pushers 116 to a predetermined position against secondary registration gates 72 at which point the collation is trail-edge stitched and then processed out of stitcher/accumulator module 10 by pushers 116. If no stitching has been selected pushers 116 transport collation 5 directly out of accumulation section 14 and containment section 16 for further processing.

Accumulation section 14 can be configured to process any traditional size document. Ramps 40 and side guides 62 are longitudinally positionable to handle sheets of any predetermined length, for example, between seven to twelve inches. Side guides 62 are positioned laterally to handle sheets of various widths. Accumulation section 14 can accumulate up to 50 documents at a high rate of speed, such as 115"/second, for further processing. A single sheet 4 is transported into accumulation section 14 by the positive drive of input belts 20 and idler rollers 26. As the sheet moves over guide ramps 40, O-ring belts 34 assist in and eventually take over moving the sheet forward. As the sheet rides over guide ramps 40 the lead edge of the sheet is received by side guide assembly 48 and is directed downward by spring plates 80 until it stops against primary registration gates 66. Guide ramps 40 are adjustable longitudinally and can be positioned in staggered arrangement based on the size of sheets being accumulated. Guide ramps 40 are positioned to ensure that O-ring belts 34 maintain a positive drive of the sheets until the lead edge stops against primary registration gates 66 at which time the trail edge of the sheet has passed over all ramps 40.

Accumulation section 14 includes an anti-kickback feature that insures end to end squareness of collation 5. For approximately the first ten sheets of collation 5, spring plates 80 function as a guide that prevents sheet 4 which is moving at a high speed from being lift over primary registration gates 66. For any additional sheets 4, spring plates 80 provide a continuous load on each sheet as it is being accumulated. This prevents the sheet from kicking back or rebounding after it hits primary registration gates 66. As the sheets are accumulated, the height of the collation rises a predetermined distance at which height spring plates 80 compress each sheet added thereafter as the sheet approaches primary registration gates 66. Each sheet added to the collation increases the deflection of spring plates 80, which continuously apply pressure to the upstream section of the collation such that the sheet being accumulated is prevented from kicking backwards after it hits registration gates 66. The lateral position of each spring plate 80 is adjustable to accommodate the variety of document widths that can be processed. It has been found that for large collations pushers 116 will not square up the sheets that are shingled within the collation. The anti-kickback feature of the present invention facilitates the squaring large collations being accumulated at high speed.

The footprint of accumulation section 14 is much shorter than typical accumulators found in inserting machines. If a jam occurs in accumulation section 14, manual removal of the collation is accomplished by lifting shaft 32 out of locking block 44, and thus lifting belts 34 off the collation for total access to the collation, allowing easy manual removal of the jams or the entire collation. Shaft 32 is then returned to a locked position in locking block 44 for normal operation.

Heretofore, stitching in high speed inserting machines has been limited to a fixed location usually in a lead or trail edge position, for example one half inch from the lead or trail edge. Typically, conventional stitchers are limited to stitching approximately thirty sheets when performing lead stitching and the maximum number of sheets that can be processed for trail edge stitching is even lower. Stitcher/accumulator 10 can process up to fifty sheets for both lead edge and trail edge stitching.

Figure 12:
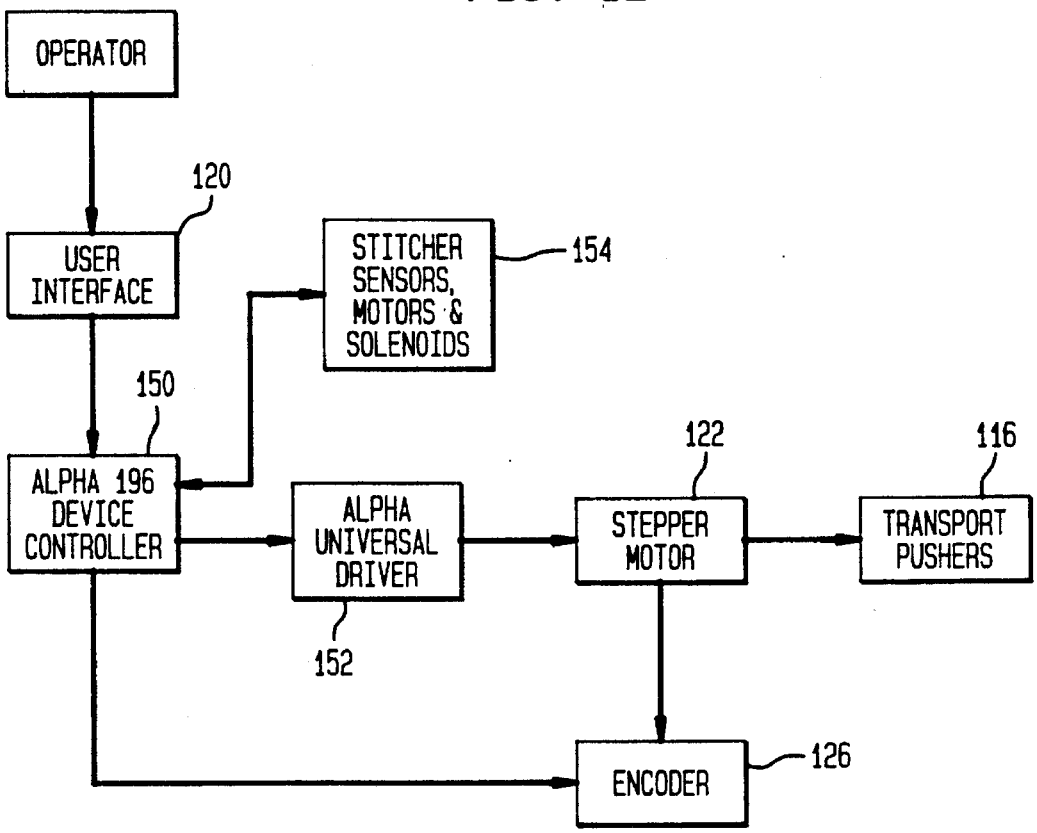
FIG. 12 is a block diagram of the programmable stitcher/accumulator system associated with the stitching apparatus of FIG. 1.

Referring now to FIG. 12, stitcher/accumulator module 10 includes a control panel 120 that provides means for an operator to program the configuration of stitcher/accumulator module 10. Operator control panel 120 is coupled to a device controller 150 which contains specific system routines that are selected, monitored and controlled by an operator through control panel 150. These routines include setup, diagnostic and operational routines that provide programmable options to customize stitcher/accumulator module 10 for each desired task. Examples of the programmable options include entering paper size, stitch mode (lead, trail or other), and trail edge offset. Examples of diagnostics include testing solenoids, home pusher test, square up pusher test, motor test and photocell transition display. Controller 150 is coupled to a driver 152 that controls stepper (servo) motor 122 which in turn controls pushers 116. Encoder 126 is coupled to stepper motor 122 and provides encoder counts to controller 150 by which controller 150 controls stepper motor 122 to move pusher 116. Controller 150 is also coupled to the solenoids that control gates 66 and 72 and stitcher 104, to motors 118 and 122, and to photocells 160–168 (shown collectively as stitcher motors, solenoids and photocells 154. In this manner, controller 150 controls the operation and diagnostic testing of stitcher/accumulator module 10.

Figure 13:
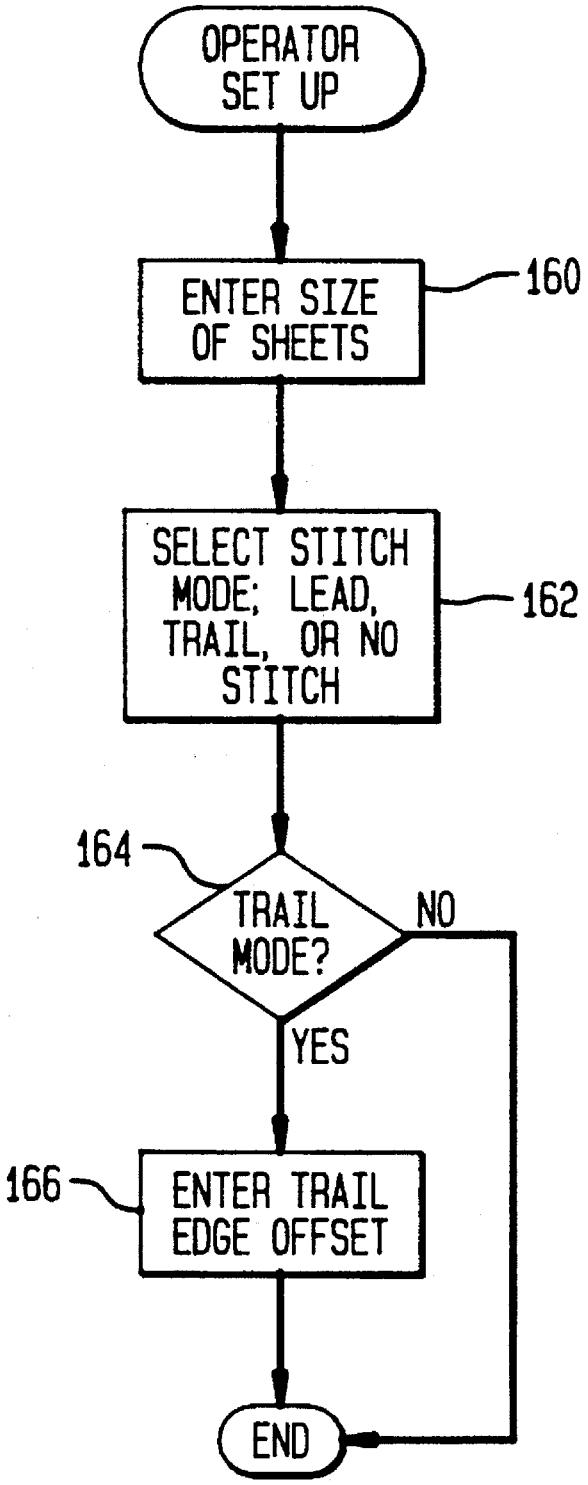
FIG. 13 is a flow chart of the operator interface setup of the stitching/accumulating apparatus of FIG. 1.
Figure 14:
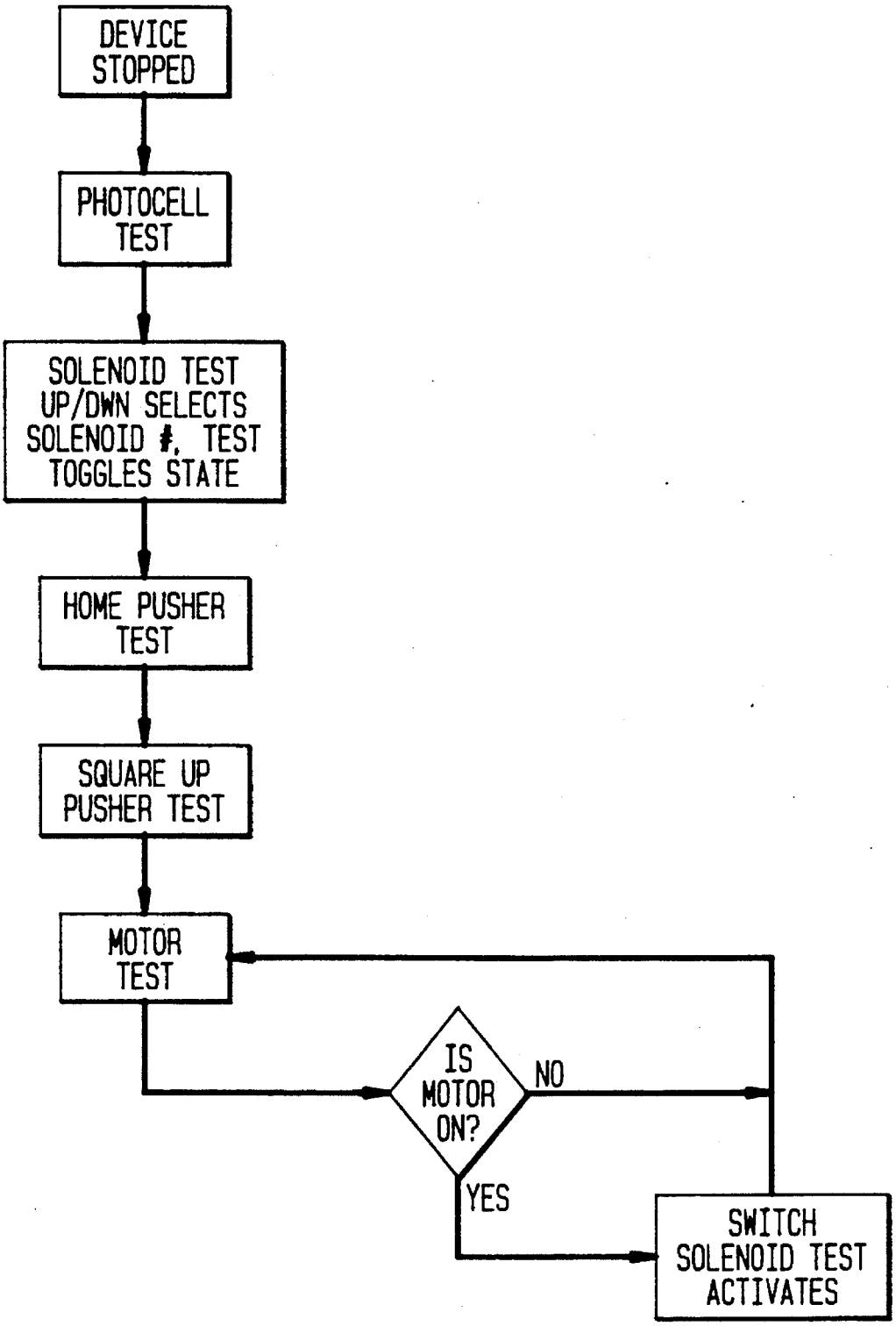
FIG. 14 is a block diagram indicating various diagnostic tests that can be performed for stitching/accumulating apparatus of FIG. 1.

Referring now to FIG. 13, a method of programming stitcher/accumulator module 10 is shown. At step 160, the operator begins the programming by entering the size of the sheets to be accumulated and stitched. At step 162, the operator selects a stitch mode (lead, trail, no stitch). At step 164, if trail mode was selected, a trail edge offset is entered at step 166. With the foregoing information entered, the routines in controller 150 control pushers 116 to maximize the throughput of the machine. Similarly, the operator can select diagnostic routines (FIG. 14) that check the system integrity of stitcher/accumulator module 10, including movement of pushers 116 to steady state positions.

Stitcher/accumulator module 10 includes a unique method for recovering from a pusher position error in a pusher controlled servo mechanism resulting from a sudden loss of power to a motor driving the pusher, such as in an emergency stop (ESTOP). If a sudden loss of power occurs while pushers 116 are moving, pushers 116 do not instantaneously stop, but rather coast to a stop because of the inertia present in collation drive system 108. Normally when such loss of power occurs, manual advancement of the pushers would be performed to avoid damage to the sheets when power is restored. The present invention includes an error recovery method for repositioning the pushers in a manner that prevents any damage to the sheets in accumulation section 14. The error recovery method repositions pushers 116 to their expected destination by slowly moving the pushers backwards and forward, as necessary, to eliminate position errors. Preferably, a slow motor profile based on the encoder counts is used to adjust pusher position rather than one based on time as in a typical real time control profile. By basing the slow motor profile on encoder counts and keeping the speed low, error in positioning the pushers is eliminated. All slow motor profiles are run when the distance to move pusher 116 forward or backward is greater than the acceleration and deceleration portions of the slow motor profile. It is also necessary to range test the distance to move the pushers to ensure that the pushers are not moved more than one cycle. This prevents damage to pushers 116 and sheets in accumulation section 14.

Figure 15A:
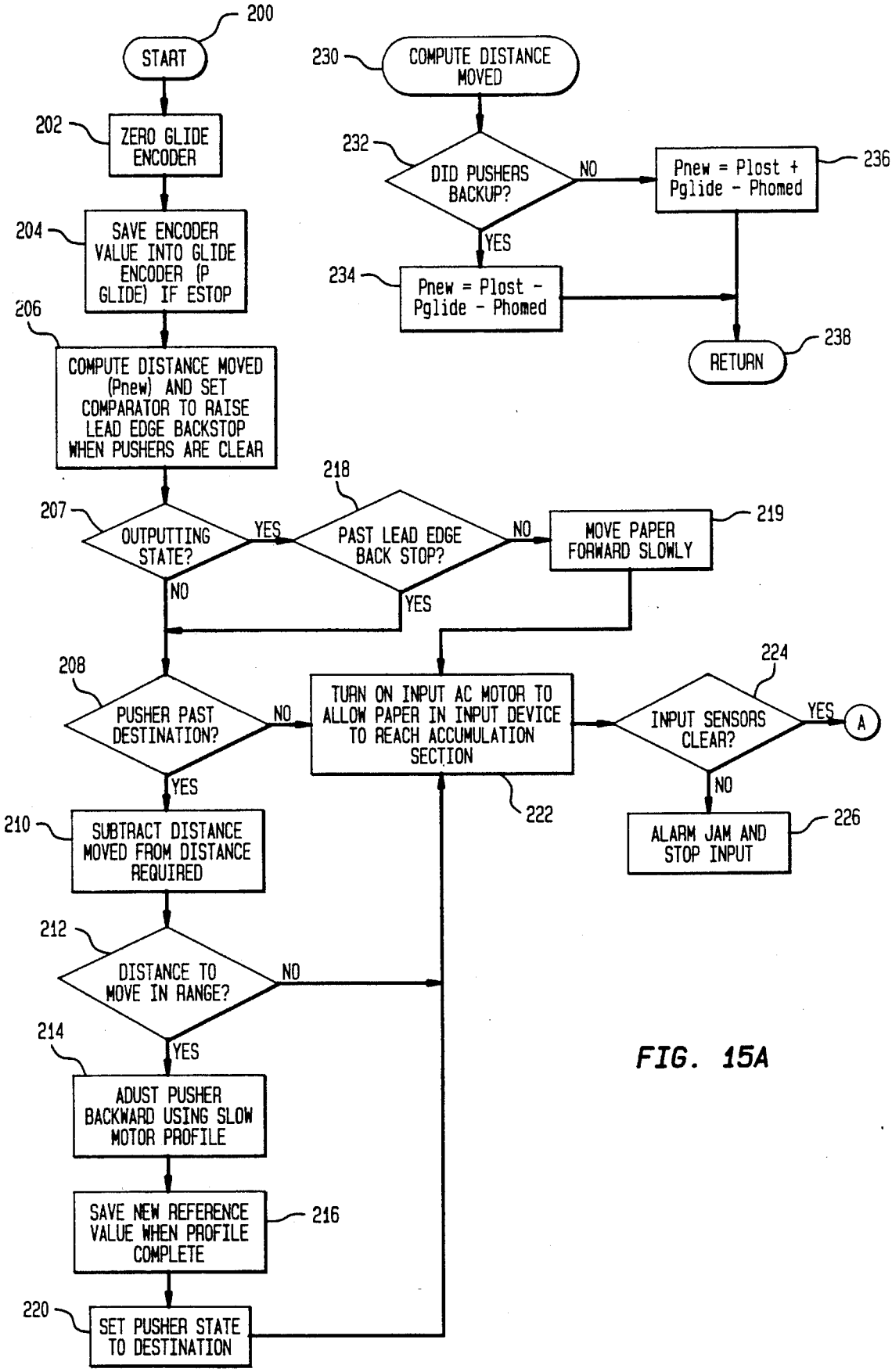
FIGS. 15A and 15B are flow charts of a pusher error recovery algorithm. de
Figure 15B:
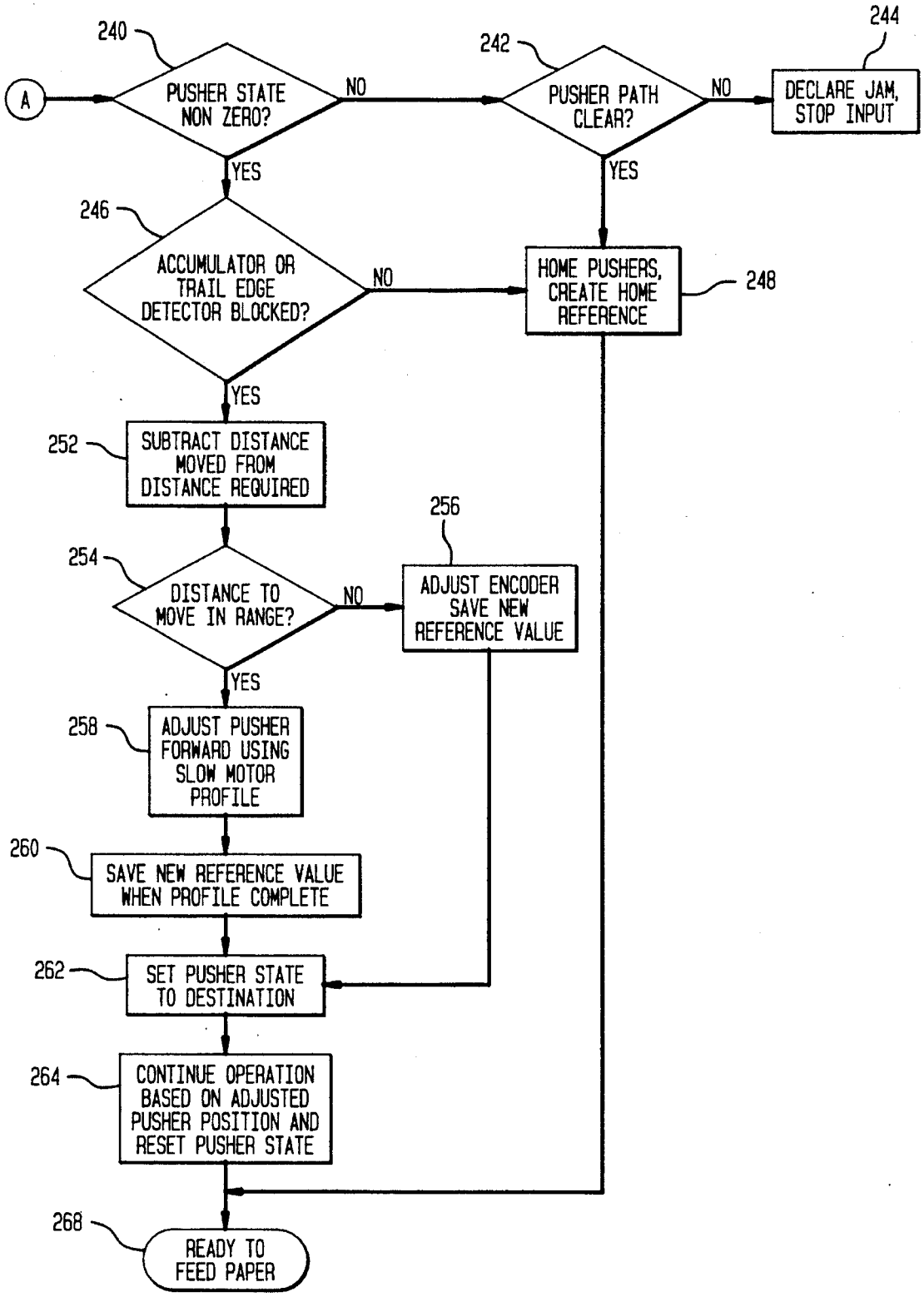

Referring now to FIGS. 15A and 15B, a full position error recovery algorithm, referred to herein as the Error Recovery Algorithm, is shown for servo controlled pushers. The algorithm uses pusher position when power was lost, pusher coasted position, a known reference point and pusher state information to adjust the pushers forward or backwards. The algorithm can be used with any pusher servo system that is programmed to be in one of several predetermined states.

Figure 11:
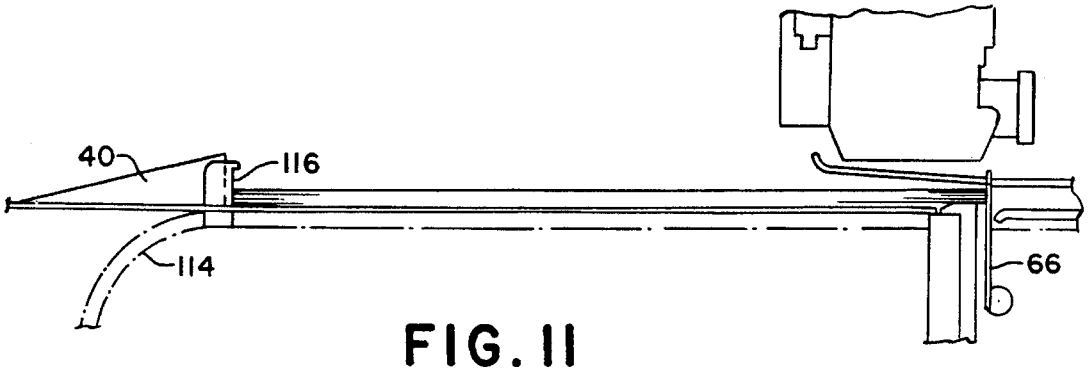
FIG. 11 is a schematic view of the stitching/accumulating apparatus of FIG. 1 with the pushers in a squared-up state.
Figure 8:
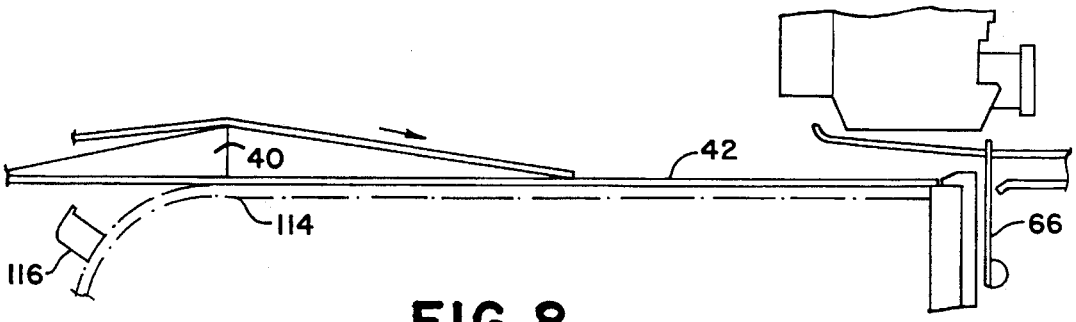
FIG. 8 is a schematic view of the stitching/accumulating apparatus of FIG. 1 with the pushers in the homed position.

Preferably, pushers 116 are programmed to be in one of the following states representing one cycle of pusher movement:

1) homed, a steady state position waiting for activation (FIG. 8);

2) homing, moving to a homed position from outputting state;

3) squared-up, steady state position having squared the collation against registration gates (FIG. 11);

4) squared-up and stitched, same as squared-up steady state position but collation stitched;

5) squaring, moving to a square position from a homed position; or 6) outputting, moving a collation.

The Error Recovery Algorithm is used to recover from any pusher position error, even position errors caused by manual movement of pushers 116 by an operator. For example, a power loss may occur when the pushers are in one of the stationary positions, i.e., homed, squared-up, or squared-up and stitched, and the operator moves the pushers from their stationary position. Preferably, the Error Recovery Algorithm is performed whenever power is restored to the pusher stepper motor so that position recovery is possible for any position error that occurs as a result of a power loss to pusher motor 122 or while there is a power loss to pusher motor 12. Thus, the Error Recovery Algorithm is performed whenever power is restored to pusher motor 122 regardless of the state of the pushers when power was lost. When power is restored to pusher motor 122, pushers 116 are first backed up in case any sheets are present in accumulation section 14. Forward positioning of pushers 116 happens after any sheets in the system are settled in accumulation section 14. This avoids damage to the sheets that may occur if pushers 116 are advanced to the next steady state position.

The error recovery method is based on an encoder count of a known reference position, such as a home pusher position. Each time pushers 116 are in a homed state the encoder count representing that steady state homed position is saved by microprocessor 150. This saved count, referred to herein as "homed encoder", provides a reference point to determine the start and final destination of pushers 116 in each cycle of pusher states.

Figure 10:
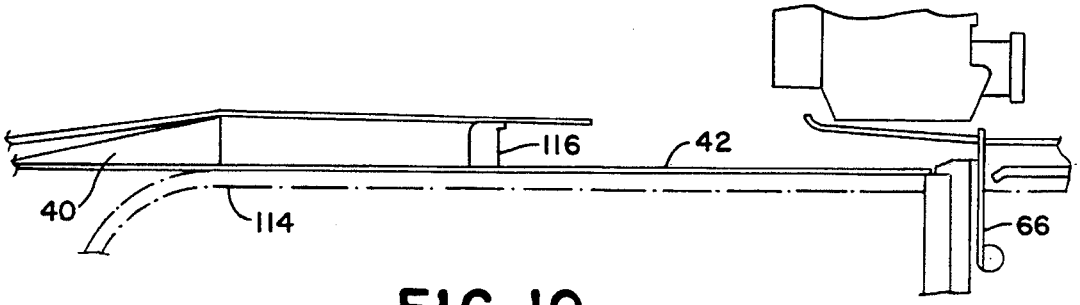
FIG. 10 is similar to FIG. 9 but with one sheet in the accumulation section.
Figure 9:
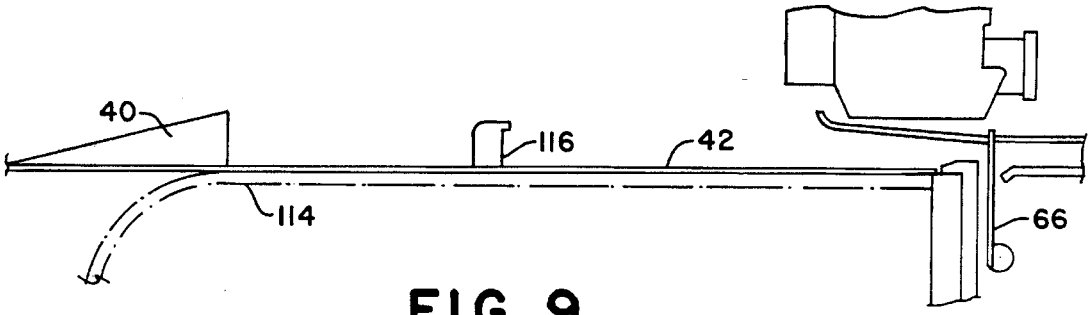
FIG. 9 is a schematic of the view of the stitching/accumulating apparatus of FIG. 1 with the pushers coasted past a homed position into an empty accumulation section.

In FIG. 8, pushers 116 are stopped in a homed position just below deck 42. In FIG. 11, the collation is complete in accumulation section 14 and pushers 116 are stopped in a squared-up position. However, in FIGS. 9 and 10, power to pusher motor 122 has been lost and pushers 116 have coasted past the homed position. In FIG. 9, no sheets are present in accumulation section 14; but in FIG. 10, a first sheet of a collation was being fed into accumulation section 14 when power was lost.

At the instant power to pushers motor 122 was lost, the count of encoder 119 at that instant is saved as a "lost power" encoder and the encoder is reset. It will be understood by those skilled in the art that during a loss of power to motor 122 encoder 119 still has power. Without power to motor 122 the inertia of collation drive system 108 caused pushers 116 to coast to a stop at the positions shown in FIGS. 9 and 10 which are past the expected destination of the pusher homed state.

In the above example, pushers 116 were in a homing state when power was lost and the expected destination was the homed position. The encoder count when power is restored, referred to herein as the glide encoder count ($P_{GLIDE}$), is then added to the lost power count ($P_{LOST}$) to determine a new encoder ($P_{NEW}$) count representing the current position of pushers 116:

$$P_{NEW}=P_{LOST}+P_{GLIDE}.$$

If $P_{NEW}$ is greater than a reference homed position encoder count ($P_{HOMED}$) plus an encoder count ($P_{distance}$) representing the distance between pushers 16 on chain drive 114, the error recovery routine runs a very slow backwards motor profile to home pushers 116. If $P_{NEW}$ is less than $P_{HOMED}$, the error routine runs a very slow forward motor profile to home pushers 116. When the profile is completed, the homed reference point is updated. Thus, by adding the lost power encoder $P_{LOST}$ to the glide encoder $P_{GLIDE}$ the error system knows where pushers 116 are when power is restored to pusher motor 122. With this information the algorithm determines whether the pushers need to be adjusted forward or backwards based on the current position and the current state of pushers 116. Whether or not any adjustment needs to be made, a new home and/or square position is computed so that the next error condition can be adjusted in the same way. Any backward movement of pushers 116 takes place before paper is allowed to settle out, that is before motor 188 is turned on to prevent additional jams. After the back up is complete motor 118 is started. Once all paper settles out any necessary forward adjustment is completed.

The foregoing summary is described with the homed state as the intended destination. It will be understood that the error recovery routine is suitable for adjusting the pusher position to any other steady state destination, for example, the squared-up state.

The foregoing summary of the error routine does not take into account any manual movement of the pushers by an operator that may cause $P_{LOST}$ to be greater than $P_{GLIDE}$, meaning the pushers were moved backwards by the operator. The following algorithm includes a determination of such manual movement of the pushers and provides the appropriate error recovery.

Referring now to FIGS. 15A and 15*b*, the algorithm for the position error recovery routine is shown. For the purpose of the following description, the intended position of pushers 116 when power is restored is the homed position. It will be understood that any steady state position could be the intended position. At step 200, the routine begins when power is restored following a loss of power (ESTOP) to the servo motor 122. As stated above, the lost power encoder ($P_{LOST}$) was saved when the power loss occurred. At step 202, a glide encoder count ($P_{GLIDE}$) is reset to zero. If power to motor 122 has been restored after an ESTOP, then, at step 204, the current encoder count is stored as glide encoder count $P_{GLIDE}$. Thus, $P_{GLIDE}$ represents the current position of pushers 116 relative to the reset encoder 119, i.e. relative to a zero encoder count. Since encoder 119 rotates in a direction corresponding to the forward or backward movement of pushers 116, the algorithm recovers from position errors caused by either forward or backward glide of pusher 116. At step 206, a compute distance moved routine, described below, is called to set a comparator that will trigger the raising of primary registration gates 66 when pushers 116 are clear.

The compute distance moved routine begins at step 230 and provides a new position ($P_{NEW}$) relative to the homed position ($P_{HOMED}$). At step 232, if the pushers are backed up from their position when power was lost, then step 234, a new position is calculated as:

$$P_{NEW}=P_{LOST}-P_{GLIDE}-P_{HOMED}.$$

If pushers 116 are forward from the lost power position, then, at 236, the new position is calculated as:

$$P_{NEW}=P_{LOST}+P_{GLIDE}-P_{HOMED}.$$

At step 208, if the new position is past the intended destination, i.e., the homed position, then pushers 116 must be backed up. At step 210, the distance moved $P_{NEW}$ is subtracted from the intended destination ($P_{REQ}$). This provides the distance ($P_{MOV}$) that pushers 116 must be moved backwards to the homed position. At step 212, if $P_{MOV}$ is less than the distance between the pushers on chain drive 114, then $P_{MOV}$ is in range for moving the pushers backwards at step 214. When pushers 116 are at the homed position, then at step 216 the count of encoder 119 is saved as a new reference encoder count. At step 212, if pushers 116 are too close to the homed reference position to run the slow motor profile, or if $P_{MOV}$ is greater than the distance between the pushers on chain drive 114, then instead of moving pushers 116 backwards, go to step 222.

At step 222, power to motor 118 is turned on to advance any sheets that had been fed from the input device but had not reached accumulation section 14 when power was lost. If the input sensors are not clear at step 216, a jam alarm is activated and the input module is stopped at step 226. If input sensors are clear, then the algorithm performs the forward adjustment of the pushers (FIG. 15B).

At step 240, the pusher state is checked to see if this is the first time power has been applied to pusher motor 122, referred to herein as a "cold start", i.e. initialization for a power up of the entire machine. If the pusher state is zero, then this is a cold start and, at step 242, the pusher path is checked. If the pusher path is not clear; then at step 244 a jam is declared and the input process is stopped. If the pusher path is clear, then at step 248, the pushers are homed and a homed reference encoder count is set in encoder 119 and the feed paper process can commence.

If the pusher state is non-zero at step 240, and if accumulator and trail edge sensors are not blocked at step 246, no sheets are present in the system and, at step 248, the pushers are homed and a homed reference encoder count is set in encoder 119 and the feed paper process can commence. If accumulator and trail edge sensors are blocked at step 246, at least one sheet is present in the system and the pushers need to be moved to the intended destination.

At step 252, the distance moved $P_{NEW}$ is subtracted from the intended destination ($P_{REQ}$). This provides the distance ($P_{MOV}$) that pushers 116 must be moved forward to the homed position. At step 254, if $P_{MOV}$ is less than the distance between the pushers on chain drive 114, then $P_{MOV}$ is in range for moving the pushers forward at step 258. If pushers 116 are too close to the homed reference position to run the slow motor profile at step 258, the homed reference point is updated instead of repositioning the pushers. When pushers 116 are at the homed position, then at step 260 the count of encoder 119 is saved as a new reference count. If, at step 254, $P_{MOV}$ is greater than the distance between the pushers on chain drive 114, then instead of moving pushers 116 forward, at step 256, the count of encoder 119 is set to represent the other pusher on chain drive 114 which is in a position behind the intended destination. At step 262, the pusher state is set as homed. At step 264, the normal operation of the stitcher/accumulator module 10 is continued.

The foregoing algorithm works for all cases of forward or backward movement when power is lost only to the pusher motor 122. Since encoder 119 has power, any movement, even manual pusher movement, becomes part of the coast or glide count previously described.

The control flow employed in stitcher/accumulator module 10 includes a tracking system that is designed to dynamically adjust the activation of stitch head 104 and servo pushers 116 based on paper size and sensing by tracking photocells 160–168 before paper is actually accumulated. This method provides optimum operation of stitcher/accumulator module 10 that significantly increases system throughput over conventional stitching devices.

Activation of pusher servo motor 122 and the clutch (not shown) controlling stitch head 104 is triggered by stitcher input photocell 160. Throughput is increased because pushers 116 and stitch head 104 are started before the accumulation of a collation is completed. For example, experimentally it may be determined that the maximum start time of stitch head 104 is 92.5 msec. Thus, pushers 116 and stitch head 104 are activated at a time that will provide a satisfactory stitch to the collation at the moment the collation is squared. This increases the system throughput and can be used for both lead edge and trail edge stitch modes.

Stitcher/accumulator module 10 represents an input module of a mail inserter system that comprises an input, insert and output sections. From a control standpoint the paper path in stitcher/accumulator module 10 is a series of clutches, brakes, rollers, belts, gates and photocells. Motion control of stitcher/accumulator module 10 includes AC motor 118 which controls the collation drive system 108, and DC servo motor 122 which controls chain drive 114 and pushers 116. Referring to FIG. 7, photocells 160–166 track sheets into and through stitcher/accumulator module 10. Photocell 168 tracks pushers 116 to the home position.

The collation accumulated in accumulation section 14 is either stitched or not stitched based a predetermined configuration made by an operator at control panel 120. The stitched collation is then pushed out of stitcher/accumulator module 10 for further processing.

Since pushers 116 are mounted on a chain drive 114 driven by servo motor 122, it is possible to start the pushers based on an occurrence of a particular event and prior to the completion of the event. The tracking system in stitcher/accumulator module 10 triggers servo motor 122 off of stitcher input photocell 160. Thus, once an end of collation (EOC) sheet is detected, servo motor 122 is started before the EOC sheet is completely moved into accumulator section 14 such that pushers 116 follow the EOC sheet into accumulator section 14 to the squared-up position. Another factor of the tracking system in stitcher/accumulator module 10 is the activation time of stitch head 104. A stitcher clutch trigger time is used to start a timer when pushers 116 begin squaring up. The timer is based dynamically on the paper size and the stitch mode. Based on the foregoing example of a maximum stitch head start time of 92.5 msec., the following algorithm provides the timer.

$$\text{Timer}=T_{Accel}+T_{Vel}-T_{Decel} \text{ if } T>92.5 \text{ msec., then Timer}=T_{Accel}+T_{Vel}-92.5 \text{ msec.}$$

This computation is dynamic because the acceleration, deceleration and constant velocity times of pushers 116 are based on sheet length when a motor profile is generated for the pusher square-up routine. When the paper size changes the length of the motion profile changes.

This method of dynamically adjusting the stitcher clutch activation time provides a maximum delay based on the pusher cycle time for square-up minus 92.5 msec. If the timer were greater than 92.5 msec., the sheet would not be squared-up in accumulator section 14. The foregoing algorithm provides a timer that allows stitch head 104 to stitch the collation at the earliest possible time to optimize system throughput. The foregoing algorithm is suitable for optimizing stitching in both lead and trail edge mode.

Stitcher/accumulator module 10 is programmed to provide selection of an input device through control panel 120. An operator can select the input device, such as, burster, high capacity sheet feeder, or cutter from control panel 120. In this manner, an operator can perform on-site system configuration of stitcher/accumulator module 10.

When the operator selects one of the foregoing sheet input devices, an input control profile generates the correct signals and tracks control flow based on the parameters entered or selected by the operator.

While the present invention has been disclosed and described with reference to a single embodiment thereof, it will be apparent that variations and modifications may be made therein. It is, thus, intended that the following claims cover each variation and modification that falls within the true spirit and scope of the present invention.

What is claimed is:

1. Apparatus for accumulating and stitching collations of sheets fed seriatim from an upstream feeding device, comprising:

a deck;

an accumulation section situated at an upstream end of said deck in which sheets are stacked to form a collation, said accumulation section including:

a stacking area, means for conveying the sheets into said stacking area, and first gating means for stopping said sheets in said stacking area to form the collation;

a containment section adjacent to a downstream end of said accumulation section, said containment section including second gating means for stopping the collation for other than lead edge stitching;

stitching means adjacent said first gating means for stitching the collation when a lead edge of the collation is at one of said first gating means and said second gating means; and means for transporting the collation from said accumulation section to said containment section and for transporting said collation from said containment section.

2. The apparatus of claim 1, futher comprising:

an input section adjacent upstream to said accumulation section, said input section including means for receiving sheets seriatim from an upstream feeding device and means for transporting each of the sheets to said accumulation section.

3. The apparatus of claim 1 wherein said accumulation section includes first guiding means for aligning the sheets and said containment section includes second guiding means for aligning the collation.

4. The apparatus of claim 1 wherein said conveying means in said accumulation section include a plurality of upper, endless, elastic belts, each of said belts moving around a pair of upstream and downstream pulleys suspended above said deck, a plurality of ramp guide blocks adjustably secured to said deck between said pairs of pulleys, wherein a lower reach of each of said belts is lower than the highest section of said ramp guide blocks, and means situated upstream from said pulleys for feeding each of the sheets over said ramp guide blocks toward said stacking area until a trail edge of the sheet moves from control of said feeding means, wherein said belts convey the sheet to said first gating means, said stacking area being a section of said deck between said stopping means and said ramp guide blocks.

5. The apparatus of claim 4 wherein said upstream pulleys are rotatably mounted on a shaft that is mounted in a pair of locking blocks, said locking blocks including means for locking said shaft in place and for unlocking said shaft for removal whereby said shaft, said upstream pulleys and the upstream end of said belts are capable of being lifted for access to a collation in the stacking area.

6. The apparatus of claim 1 wherein said second gating means includes positioning means for longitudinally positioning said second gating means whereby said stitching means stitches at a desired location of the collation for other than lead edge stitching.

7. The apparatus of claim 6 wherein said positioning means includes a rack and pinion longitudinal gate position adjustment mechanism.

8. The apparatus of claim 1 wherein said transporting means includes at least a pair of laterally spaced pushers mounted respectively on a pair of chain drives controlled by a servo motor, said chain drives having an upper reach moving through longitudinal grooves in said deck.

9. The apparatus of claim 8 wherein said pushers square the collation against said first gating means as a last sheet of the collation stops against said first gating means.

10. The apparatus of claim 1 wherein said first and second gating means include a pair of rigid stop members that pivot to a vertical stop position above the deck for stopping the sheets and the collation, respectively, and that pivot below the deck when said transporting means transports said collation from said accumulation section and said containment section, respectively.

11. The apparatus of claim 1, further comprising a side guide device suspended above said stacking area for aligning sheets conveyed seriatim to said stacking area, said side guide device being adjustable both longitudinally and laterally.

12. The apparatus of claim 11 wherein said side guide device includes a pair of guide plates each having vertical and horizontal members, a transverse mounting plate, and a pair of rail members mounted on opposite frame members in said accumulation section, each of said rail members including a longitudinal groove wherein ends of said transverse mounting plate are adjustably positioned within the grooves of said rail members whereby said guide plates are positionable longitudinally, and wherein said transverse mounting plate includes at least two lateral slots through which said guide plates are adjustably mounted whereby said guide plates are positionable laterally.

13. The apparatus of claim 12 wherein said side guide device further includes means for locking said transverse mounting plate at a fixed position in said grooves of said rail members.

14. The apparatus of claim 1 wherein said accumulation section further includes spring guide means suspended above the downstream end of said stacking area, said spring guide means preventing the lead edge of the sheets conveyed by said conveying means from rising above said gating means, said spring guide means also applying a spring force against the lead edge of the sheets to prevent the sheets from kicking back after being conveyed against said gating means.

15. The apparatus of claim 1 further including a control panel for entering sheet size, and for selecting type of stitching and position of stitch.

16. The apparatus of claim 1, further comprising means for controlling said transporting means wherein said transporting means squares the collation at substantially the moment an end of collation sheet is conveyed against said first gating means.

17. The apparatus of claim 16 wherein said controlling means includes encoder means for tracking and controlling the position of said pushers.

* * * * *